US006202357B1

(12) United States Patent
Spradlin

(10) Patent No.: US 6,202,357 B1
(45) Date of Patent: Mar. 20, 2001

(54) HYDRODYNAMIC ROOF WATER INTAKE AND WASTE DISPOSAL DEVICE

(76) Inventor: Erdman O. Spradlin, 360 Green Acres Dr., Naperville, IL (US) 60540

( * ) Notice: Subject to any disclaimer, the term of this patent is extended or adjusted under 35 U.S.C. 154(b) by 0 days.

(21) Appl. No.: 09/195,416

(22) Filed: Nov. 20, 1998

(51) Int. Cl.[7] ..... E04D 13/04
(52) U.S. Cl. ..... 52/12
(58) Field of Search ..... 52/11–16

(56) References Cited

U.S. PATENT DOCUMENTS 2,271,081 * 1/1942 Layton ..... 52/12
2,935,954 * 5/1960 Matthews et al. ..... 52/12 X
4,631,875 * 12/1986 Olson ..... 52/12
4,667,448 * 5/1987 Smith ..... 52/12
5,271,191 * 12/1993 Vahamaki ..... 52/12
5,640,810 * 6/1997 Pietersen ..... 52/12
6,067,755 * 5/2000 Maanum ..... 52/12

* cited by examiner

*Primary Examiner*—Richard Chilcot
(74) *Attorney, Agent, or Firm*—Robert L. Marsh

(57) ABSTRACT

A device for extending across a gutter for separating trash from rain water running off a roof has a planar metal body secured to the roof and to the outer edge of the gutter. A plurality of elongate louvers are cut into the metal body so that they extend parallel to the gutter. The louvers are arranged in columns and are twisted to form openings between which the water will flow.

11 Claims, 5 Drawing Sheets

HYDRODYNAMIC ROOF WATER INTAKE AND WASTE DISPOSAL DEVICE

BACKGROUND OF THE INVENTION

The present invention relates to a device for separating trash from run off water coming from a roof and, in particular, to a device for collecting run off water in a rain gutter while directing trash separated therefrom over the outer edge of the gutter.

Gutters are provided on houses to collect rain water running off the roof thereof so that it will not cascade down across doorways and windows. Unfortunately, trash, such as leaves and branches from trees and the like, are blown onto the roof and are washed into the gutter system. The trash accumulates and clogs the gutter system such that it no longer performs the function of collecting and removing run off water.

In the past, efforts have been made to provide a porous shield, such as a screen, along the upper surface of the gutter so that water running off a roof could pass through the screen and into the gutter while trash floating with the water is prevented from entering the gutter. Such shields or screens have only been partially successful. Where the mesh of the screen is small, it has been found that the flowing water running from the roof will skim along the upper surface of the screen and flow over the outer edge of the gutter without passing through the pores thereof thereby rendering the gutter system useless. On the other hand, where the mesh of the screen is too large, smaller particles of trash pass through the openings thereof and into the gutter system causing it to clog. Furthermore, generally planar pieces of trash such as leaves and pieces of paper can collect in the upper surface of the screen and inhibit the flow of water into the gutter system.

There have been other efforts to separate run off water from trash which has fallen on a roof. Knittel, U.S. Pat. No. 5,010,696 discloses a protective shield for extending across a gutter having a plurality of spaced downwardly descending steps where the steps are oriented parallel to the length of the gutter and are spaced from one another by an elongated slot having openings therein for allowing water to flow between the steps and into the gutter below.

Meckstroth, U.S. Pat. No. 5,181,350, disclosed a covering for a rain gutter having an arcuate lip at the outer end thereof such that water running off the roof adheres to the arcuate cover and is directed into the gutter while the trash is expelled over the edge thereof.

Davis, U.S. Pat. No. 4,745,710 discloses a gutter screen comprised of a plurality of parallel cylindrical ribs retained parallel to the longitudinal axis of the gutter.

Duffy, U.S. Pat. No. 4,493,588 discloses a curved upper surface similar to Meckstroth whereby water is directed into the gutter while the trash is expelled over the outer edge.

Despite all of the foregoing efforts, the problem remains unsolved. Where a house is positioned among trees, the gutters thereof fitted with devices according to the existing technology still becomes chronically clogged with trash coming from the trees and the like.

One problem with existing systems is that they do not adequately handle the volume of water which will flow off a roof. Since the roof covers the entire floor area of a house, the flow into a gutter system can be substantial, even in a relatively light rain fall. Existing devices, such as those that rely on the surface tension of water to turn the flow of water into a gutter fail when there is any significant rainfall.

SUMMARY OF THE INVENTION

Briefly, the present invention is embodied in a device for separating trash from run off water coming from a roof such that the water can be collected in a gutter and the trash will fall across the outer edge of the gutter. The device is adapted for use on any slope of a sloped roof in conjunction with an elongate gutter having a generally u-shaped cross section. The U-shaped cross section is formed by a vertical panel or fascia panel for mounting against the fascia of a structure, a bottom panel forming the bottom of the U-shaped gutter, and an outer panel forming the vertical portion of the U-shape opposite the fascia panel. In accordance with the invention, the gutter is configured with the height of the upper edge of the outer panel defining a line which falls within an extension of the plane formed by the surface of the roof. Extending from the outer edge of the roof to the upper edge of the outer panel is a rigid, planar separator member having a plurality of elongate louvers therein.

Each of the louvers in the separator member has an inner edge and an outer edge and the metal material between the inner and outer edges thereof define a plane, which is tilted with respect the plane of the separator member by an angle of approximately 15 degrees. In the preferred embodiment, the louvers are not straight, they are arcuate having a length of about one inch and a spacing between louvers of about 0.030 inch. The louvers are arranged in columns with about fifty louvers in each column spanning a distance of about five inches. The louvers are oriented generally parallel to the length of the gutter and the columns of louvers extend across the width of the gutter and have a shallow trough therein. Water running off a roof washes into the trough of one of the columns and across the associated louvers until hydrodynamic forces draw the water between the louvers and into the gutter below. Preferably, the louvers are formed in a die cutting operation, and the texturing of the material caused by the die cutting operation will enhance the rigidity of the separation member.

BRIEF DESCRIPTION OF THE DRAWINGS

A better understanding of the present invention will be had after a reading of the following detailed description taken in conjunction with the drawings wherein.

DETAILED DESCRIPTION OF A PREFERRED EMBODIMENT

Figure 1:
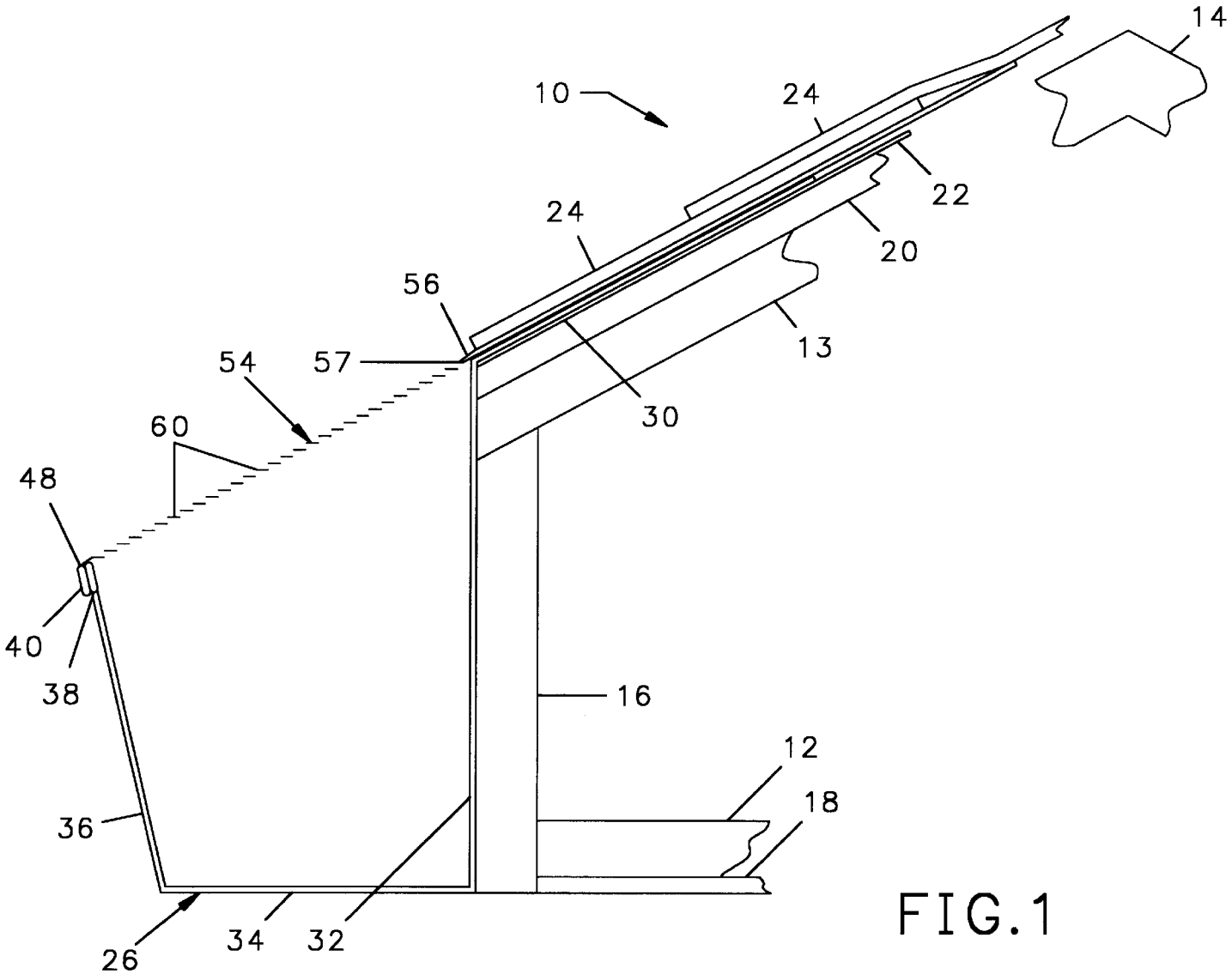
FIG. 1 is a cross-sectional view of a roof, gutter and separating member in accordance with the present invention.

Referring to FIG. 1, the roof 10 of a structure includes a plurality of ceiling joists 12 and a plurality of elongate roof beams 13 which extend from the peak of the roof 14 to its outmost edge. Extending below the outer edge of the roof 14 is a fascia 16, and if the roof has an overhang, below the fascia 16 there is a soffit 18. Nailed to the upper surfaces of the wood roof beams 14 are plywood sheathing 20, above the sheathing 20 is a barrier of tar paper 22, and above the tar paper are lapped panels of asphalt shingles 24.

The roof 10 has an incline, and the most common rate of incline for a roof is six inches of drop for each one foot distance from the peak, or 6" to 12". The rate of incline for a roof can vary anywhere from between 2" to 12" at one extreme to 12" to 12" at the opposite extreme.

Figure 2:
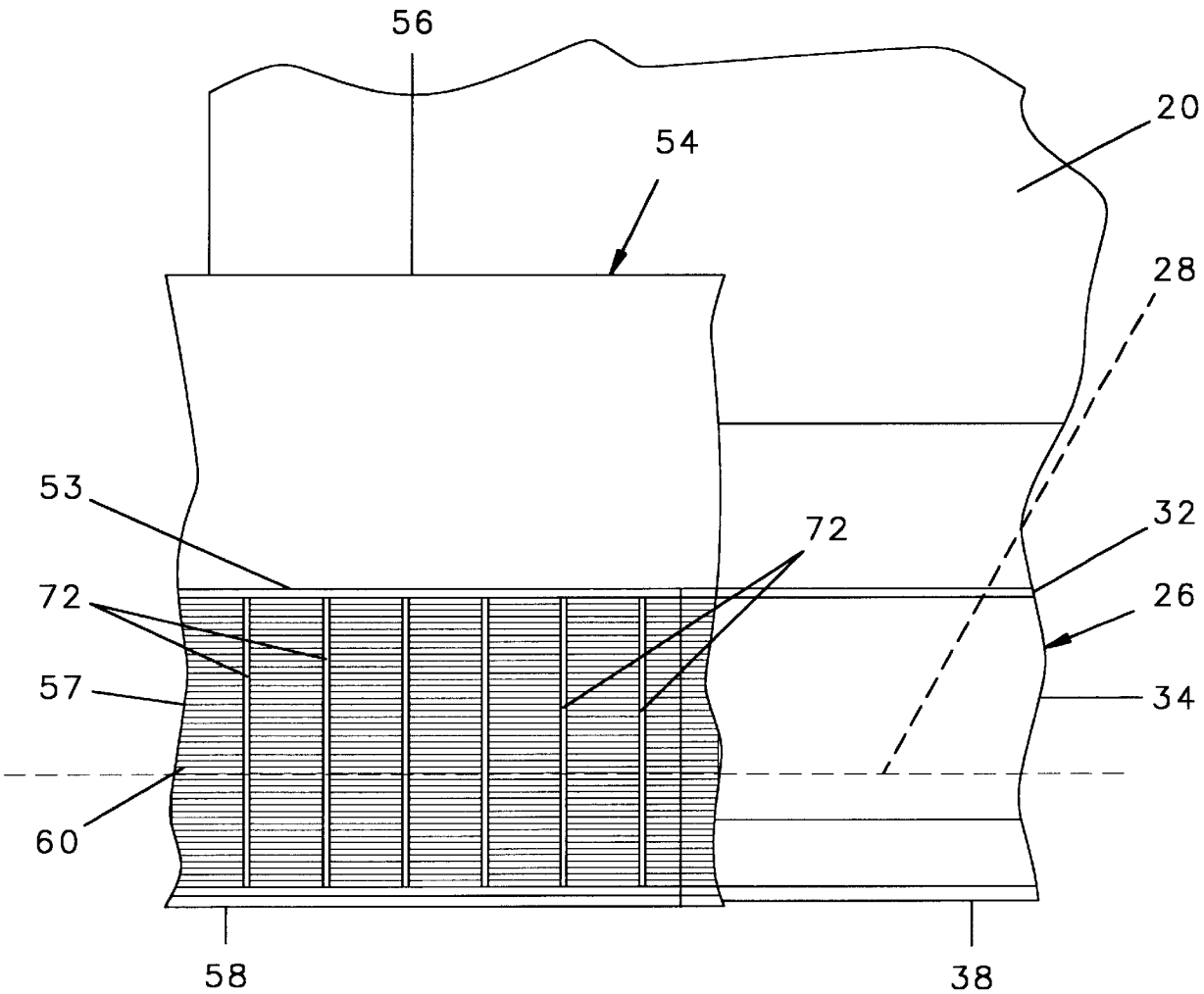
FIG. 2 is a fragmentary top view of a separator member in accordance with the present invention.

Referring to FIG. 1 and 2, the present invention is adapted to be used in conjunction with a gutter 26 formed from an integral piece of a suitable metal, such as aluminum, which is folded and stamped into an elongate member having a longitudinal axis 28. To ensure that water from the roof 10 does not back up and migrate behind the facia 16 and run onto the soffit 18, the gutter 26 has an upper flange 30 adapted to fit above the tar paper 22 and under the lowermost layer of asphalt shingles 24. Extending downward from the upper flange 30 along the outer surface of the fascia 16 is a fascia panel 32, extending along the lower surface of the gutter 26 is a bottom panel 34, and extending generally parallel to the fascia panel 32 and completing the generally U-shaped cross-sectional shape of the gutter 26 is an outer panel 36, the upper edge 38 of which has a crimp 40 therein.

Figure 6:
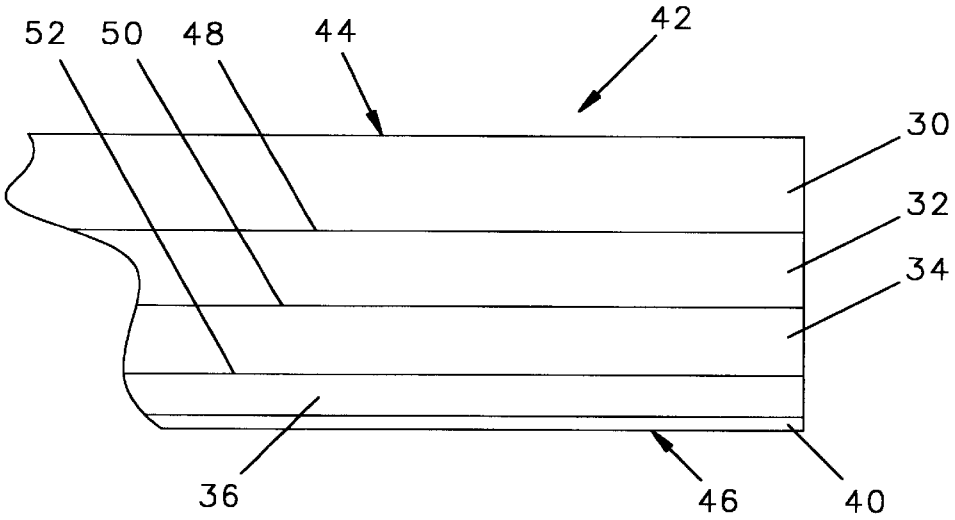
FIG. 6 is a fragmentary top plan view of a gutter blank for use with one embodiment of the invention.

The gutter is an important feature of the present invention. It may be either preformed, as are existing gutters, or it may be formed on the work site. Referring to FIG. 6, a gutter 26 can be formed at the work site by providing an elongate gutter blank 42 having parallel sides 44,46, one of which 46 has the crimp 40 folded therein to form the upper edge 38 of the gutter 26. Extending longitudinally through the blank 42 parallel to the sides 44, 46 are crease 48, 50, 52 to facilitate the folding of the blank 42 into the formed gutter 26. The outer edge 44 and first crease 48, therefore, define the edges of the upper flange 30, creases 48 and 50 define the edges of the fascia panel 32, creases 50 and 52 define the lower panel 34 and crease 52 and outer edge 46 define the outer panel 36.

The gutter blank 42 is installed and formed into a gutter 26 by first nailing the upper flange 30 under the free ends of the lower shingles 24 of a roof such that edge 46 of the blank 42 extends outward of the roof. Thereafter the blank 42 is successively folded along creases 48, 50, 52 to form the gutter 26.

Referring to FIGS. 1 and 2 in the preferred embodiment, the upper edge 38 of the outer panel 36 is at a lower elevation than the upper edge of the fascia panel, and extending across the gutter, from the upper edge 38 of the outer panel to the upper edge of the fascia panel 32, is an intake panel 54 made of a suitable metal such as aluminum or galvanized steel. The intake panel 54 is oriented at an angle of about 22 degrees from the horizontal which is the approximate slope of 6" to 12" roof.

A significant feature of the gutter 26 is the mounting portion 30 which extends under the ends of the lower most row of roof shingles 24 and thereby prevents water from working between the fascia 16 and the gutter 26.

As shown in FIGS. 1 and 2, the intake panel 54 has an elongate mounting portion 56 which is secured by roofing nails or the like over the upper flange 30 of the gutter 26, and opposite the mounting portion 56 is an elongate folded outer edge 58, the distal end of which locks around the crimp 40 of the gutter 26 to retain the central portion 53 of the intake panel 54 across the trough of the gutter 26. Between the mounting portion 56 and the central portion of the intake panel 54 is a crease 57 which facilitates the bending of the panel 54 to accommodate a roof slope which is different from the slope at which the central portion 53 extends from the upper ends of the fascia panel 32 to the upper end 38 of the outer panel 36.

Figure 3:
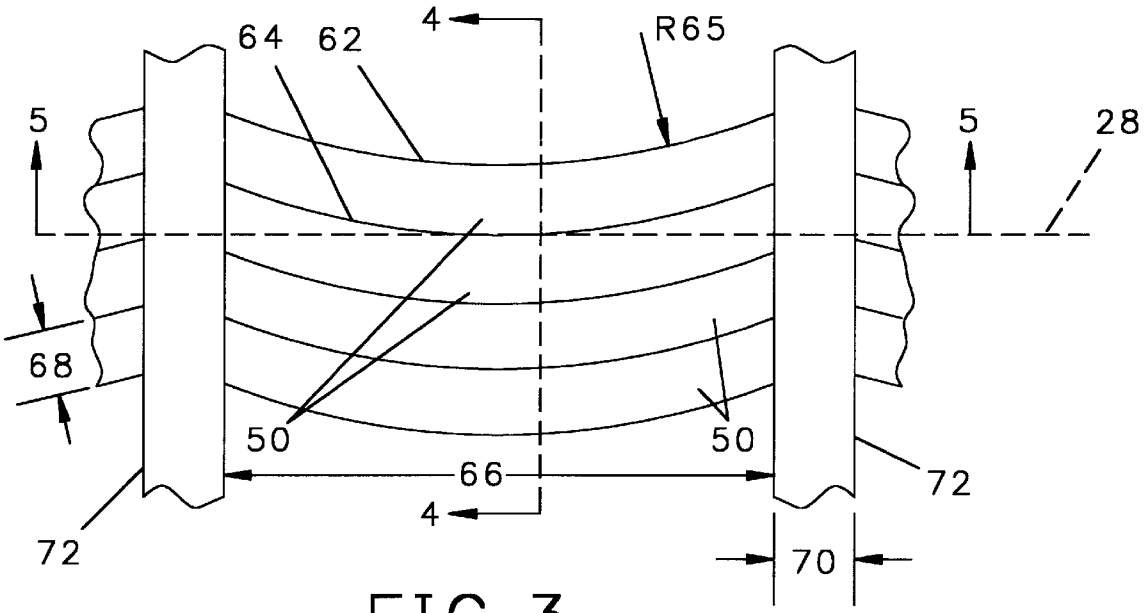
FIG. 3 is a fragmentary enlarged top view of a portion of the separator member as shown in FIG. 2.

As best shown in FIGS. 2, 3, 4, and 5 between the mounting panel 56 and the outer edge 58 are a plurality of columns of longitudinally oriented louvers 60—60, each of which has an inner edge 62 and an outer edge 64 defining a length 66 and a width 68. Each louver 60 has a length 66 of about one inch and a width 68 of about 0.100 inch, and the spacing 70 between columns of louvers of about 0.125 inch. As best shown in FIG. 3, each louver 60 has a generally arcuate shape defined by arcuately shaped inner edge 62 and arcuately shaped outer edge 64 where the arcs of edges 62 and 64 are segments of a circle having a radius 65 of about 12 inches.

Figure 4:
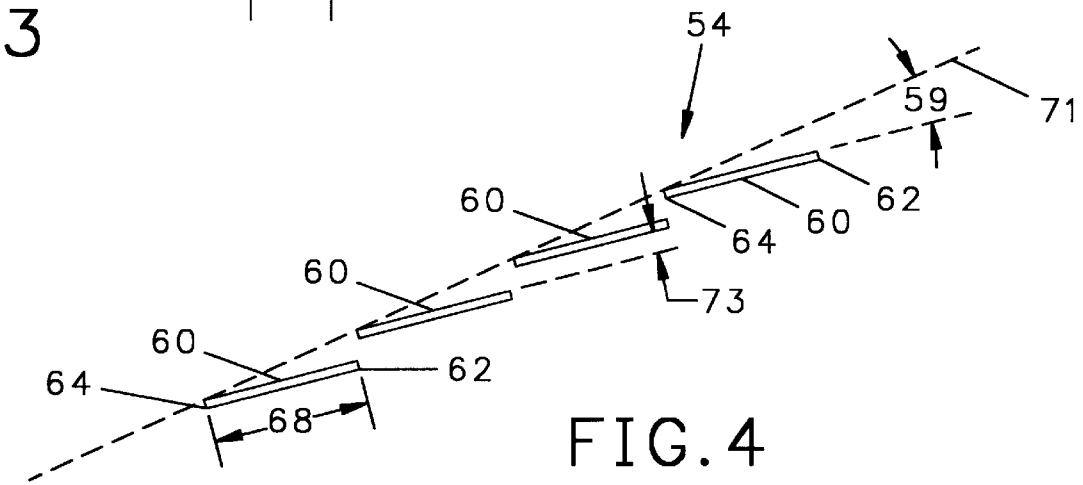
FIG. 4 is an enlarged cross-sectional view of the separator member taken through lines 4—4 of FIG. 3.
Figure 5:
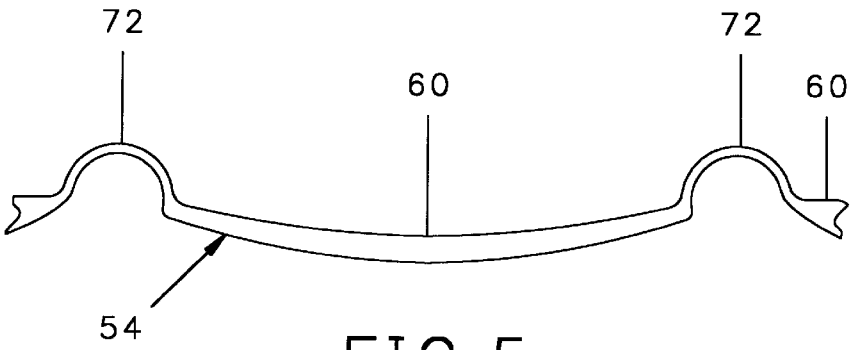
FIG. 5 is an enlarged cross-sectional view of the separator member taken through lines 5—5 of FIG. 3.

As best shown in FIG. 4, each of the louvers 60 is twisted with respect to a plane 71 defined by the intake panel 54, and in the preferred embodiment, the angle 59 of the twist is approximately 15 degrees to form a spacing 73 between the louvers of about 0.030 inch. Between columns of louvers 60 are transverse ribs 72 which are preferably contoured as shown in FIG. 5 to maximize the rigidity of the intake panel 54.

Preferably the intake panel 54 is manufactured in a stamping operation in which a suitable planar piece of metal is first cut to size after which the folds which define the outer edge 58 are stamped therein. The louvers 60 are then formed by a plurality of parallel cuts made into the surface of the metal and a pressing operation will thereafter twist the surfaces of the louvers 60 fifteen degrees to reach the configuration of the intake panel 54 as disclosed.

It has been found that where a roof 10 has been fitted with a gutter 26 and intake panel 54 in accordance with the present invention, that water flowing down the roof will wash across the upper surface of the first few louvers 60—60 encountered by the water flow. While the water washes across the upper surface of those first few louvers, a film of water will collect along the lower surfaces of those louvers, and the water along the lower surface will tend to move downwardly along the lower surfaces and form a thicker layer as it moves. Eventually, the water film on the lower surface of the louvers will thicken until the weight of the accumulated water will overcome the surface tension and adhesion properties which retain the water film and it will fall into the gutter below. Once water begins to flow into the gutter from the lower surface of the intake panel 54, the falling water will draw water from the upper surface of the intake panel 54, through the slots formed between the louvers 60—60. Soon water will flow through the panel 54 as though there were no obstructions caused by the panel 54. Tests have shown that an intake panel 54 can pass water into a gutter at a rate which is equal to a rainfall of 24 inches per hour. On the other hand, trash which accumulates on the roof 10 will be washed by the flow of water onto the upper surface of the intake panel 54, but will not be drawn through the louvers 60. Ultimately, the trash will be washed across the outer edge 58 of the intake panel 54 and fall to the ground below.

Figure 7:
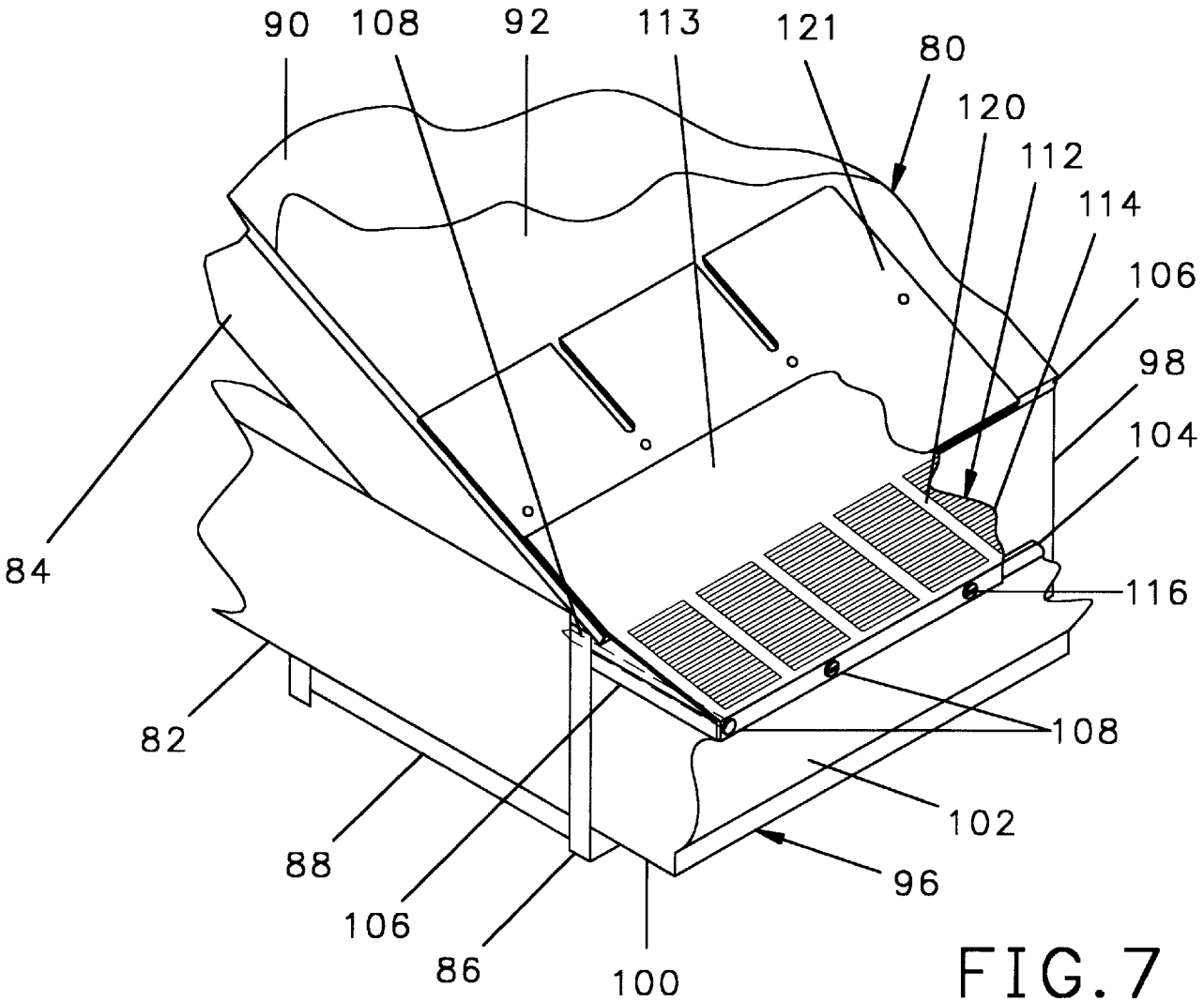
FIG. 7 is an isometric view of a second embodiment of the invention wherein the separator member is adapted for use with a presently available gutter.

Referring to FIG. 7, in which the present invention is modified to accommodate a gutter of the type currently available. In accordance with this embodiment, a roof 80 consists of ceiling joists 82, beams 84, a fascia 86 and a soffit 88 all as described with respect to the first embodiment. The supporting members 84 are in like manner covered by a sheathing 90, tar paper 92. The inverted starter row 121 of asphalt shingles is shown but the upper layer of the shingles are not shown. In this embodiment, the conventional gutter 96 has a fascia panel 98, a bottom panel 100 and an outer panel 102. Unlike the gutter 26 described with respect to the first embodiment, the upper edge 104 of the outer panel 102 thereof has approximately the same elevation as that of the outer edge 106 of the fascia panel 98. In this embodiment, a plurality of nails 108 extend through the outer panel 102, through a tubing, through the fascia panel 98 and into the wood of the fascia 86 to retain the gutter 96 to the building.

The intake panel 112 includes a mounting portion 113, a central portion 114 which extends above the trough of the gutter 96, and an outer lip 116 having a plurality of holes therein not shown. The nails 108 which retain the gutter 96 to the building also extend through the holes in the outer lip 116 of the intake panel 112. The central portion 114, which extends across the trough of the gutter 96 comprises a plurality of louvers 120—120 which are identical to the louvers 60—60 as described above with respect to the intake panel 54.

EXAMPLE

A model of a roof water intake system in accordance with the present invention was constructed. The model had one inch long arcuate louvers, twisted at an angle of about 15 degrees, with spacings of 0.030 inch between louvers. The louvers were arranged in columns as described above and shown in the drawings. A measured 24 inch per hour water flow was then directed down a simulated roof top and on to the intake system. At first the water washes across the top first few louvers then starts passing between louvers near their outer edges. Once water began flowing through the outer edges of the louvers, the hydrodynamic forces of the moving water caused water to flow between the adjacent inner louvers until water freely passed between all the louvers and into the gutter.

While two embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. The combination of a gutter, and an intake panel comprising:

a U-shaped gutter member having a generally vertically oriented fascia portion, a bottom portion, a generally vertical outer portion, and having a longitudinal axis, means for attaching said fascia portion along an edge of a roof, said fascia portion having an upper edge and said outer portion having an upper edge, said upper edge of said fascia portion having a higher elevation than said upper edge of said outer portion, an intake panel extending from said upper edge of said fascia portion to said upper edge of said outer portion, said intake panel defining a plane oriented at a first angle with respect to a horizontal, said intake panel sloping in a first direction, said first direction being downwardly away from said fascia portion, said intake panel having a plurality of elongate louvers therein, each of said louvers having an inner edge, an outer edge, and a surface generally defining a plane, said plane of said louvers oriented at a second angle with respect to a horizontal where said second angle slopes downwardly in said first direction, and said louvers oriented generally parallel to said longitudinal axis of said gutter.

2. A device in accordance with claim 1 wherein said louvers are arcuate in shape.

3. A device in accordance with claim 1 wherein said louvers are at an angle of about 15 degrees with respect to said plane defined by said intake panel.

4. A device in accordance with claim 1 wherein said rigid planar intake panel employs hydrodynamic forces to move water between said louvers.

5. A device in accordance with claim 1 wherein said louvers are at an angle with said plane of said intake panel to provide an opening of about 0.030 inch between adjacent louvers.

6. A device in accordance with claim 1 wherein said louvers have a length of about one inch and a width of about 0.100 inch.

7. A device in accordance with claim 1 wherein said louvers are arranged in rows parallel to one another in a plurality of columns.

8. A device in accordance with claim 1 wherein said intake panel further comprises, an elongate mounting portion, an elongate central portion having said louvers therein, said mounting portion for attachment to the sheathing of a roof.

9. A gutter in accordance with claim 1 and further comprising, said plane of said intake panel being at an angle of about 22 degrees from horizontal.

10. A device in accordance with claim 1 wherein said louvers have an arcuately shaped inner edge and an arcuately shaped outer edge.

11. A device in accordance with claim 10 wherein said louvers define a plane and said plane of said louvers is twisted at an angle with respect to said plane of said intake panel.

* * * * *